US005774929A

United States Patent [19]

Jürgens et al.

[11] Patent Number: 5,774,929

[45] Date of Patent: Jul. 7, 1998

[54] WRINGING DEVICE FOR A WET MOP HEAD OF A MOP HEAD CARRIER

[75] Inventors: Ralf Jürgens, Neckarhausen; Uwe Dingert, Abtsteinach, both of Germany

[73] Assignee: Firma Carl Freudenberg, Weinheim, Germany

[21] Appl. No.: 690,417

[22] Filed: Jul. 25, 1996

[30] Foreign Application Priority Data

Jul. 25, 1995 [DE] Germany ..... 195 27 158.0

[51] Int. Cl.[6] ..... A47L 13/60

[52] U.S. Cl. ..... 15/262; 100/121; 100/132; 100/171; 100/176

[58] Field of Search ..... 15/262; 68/256; 100/121, 132, 171, 176

[56] References Cited

U.S. PATENT DOCUMENTS

| | | | |
|---|---|---|---|
| 36,458 | 9/1862 | Emerson | 68/256 |
| 1,463,750 | 7/1923 | Poulsen | 15/262 |
| 1,679,980 | 8/1928 | Lawlor | 15/262 |
| 3,346,906 | 10/1967 | Harrison et al. | 15/262 |
| 3,430,286 | 3/1969 | Bownes | 15/262 X |

FOREIGN PATENT DOCUMENTS

| | | | |
|---|---|---|---|
| 251128 | 10/1912 | Germany | 15/262 |
| 83406 | 3/1954 | Norway | 15/262 |
| 29999 | 12/1913 | United Kingdom | 15/262 |

*Primary Examiner*—Mark Spisich
*Attorney, Agent, or Firm*—Kenyon & Kenyon

[57] ABSTRACT

A wringing device for a wet mop head of a mop head carrier, wherein the wringing device comprises an elastically prestressed, resilient base element and two wringing rollers that are mounted on the base element, the wringing rollers adapted to rotate parallel to one another and arranged to move away from each other in parallel fashion counter to the elastic prestress force in the base element.

35 Claims, 7 Drawing Sheets

WRINGING DEVICE FOR A WET MOP HEAD OF A MOP HEAD CARRIER

FIELD OF THE INVENTION

The invention relates generally to a wringing device for a wet mop head of a mop head carrier. The wet mop head is removably attached to a mop head carrier of a floor cleaning apparatus. In particular, the invention relates to a wringing device that presses cleaning solution out of a wet mop head, which preferably covers both main sides of a plate-shaped or frame-shaped mop head carrier. The mop head carrier is part of a manually operated or motor-driven wet-mopping apparatus. An activation rod is connected to the mop head carrier and can be manually or mechanically activated.

BACKGROUND OF THE INVENTION

Wringing devices of this type are very complicated in design, difficult to handle and require a relatively high level of maintenance. In addition, the known wringing devices often do not fulfill the requirements of hygiene required of them.

Therefore, there remains a need to improve wringing devices of the type mentioned above so that the wringing device is easily handled and is suitably hygienic.

There also remains a need to develop a wringing device that provides significantly increased wringing performance, has low maintenance requirements and can be economically manufactured.

SUMMARY OF THE INVENTION

The present invention meets these needs with a wringing device that comprises a base element composed of a resilient, elastically prestressed material and two cylindrical wringing rollers that are mounted in the base element and whose axes are coplanar and parallel to each other. The elastic prestress force urges the two wringing rollers towards each other. When a force is applied to spread the wringing rollers apart counter to the elastic prestress force in the base element, the axes of the wringing rollers remain parallel.

The base element is preferably U-shaped, ribbed and has bearings attached to it, which are used to secure the wringing rollers in place. End walls are attached to the two ends of the base element, and side guides are formed at the top ends of the end walls. The side guides provide a slide that facilitates the proper insertion of the mop head into the wringing device. Guide elements may also be provided that facilitate insertion of the mop head; the guide elements may be ribbed. Attachment guides are secured to the end walls and fasten the wringing device onto the rim of a collection container.

The end walls are attached only at the bottom of the base element and extend away from the base element, thus providing a drainage opening for the squeezed out cleaning solution. Drain openings are also provided in the wringing rollers and in the bottom of the base element.

An ejector device may also be provided to assist in removing the mop head from the wringing device.

DETAILED DESCRIPTION

Figure 1:
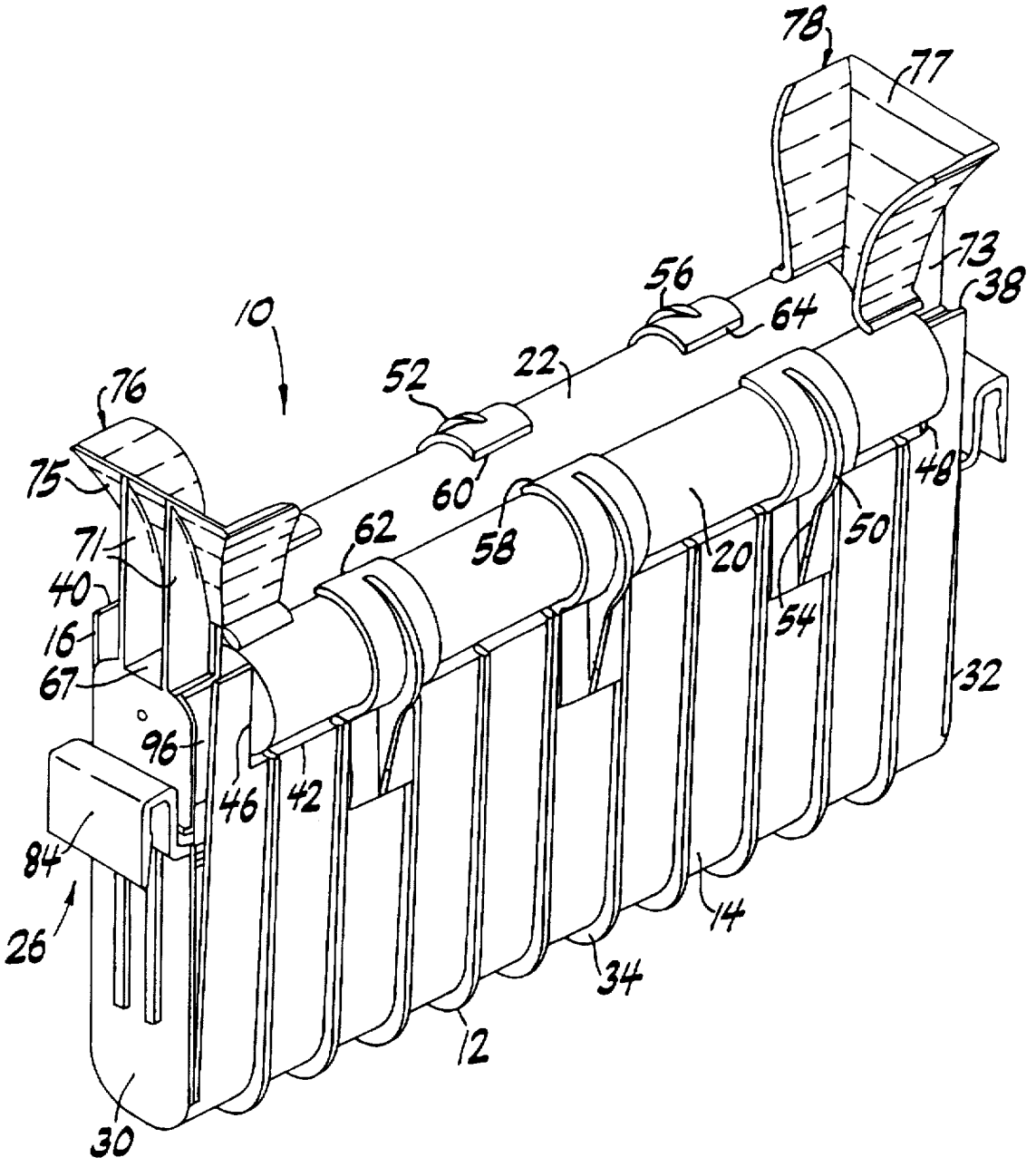
FIG. 1 illustrates a perspective view of a first embodiment of a wringing device.
Figure 4:
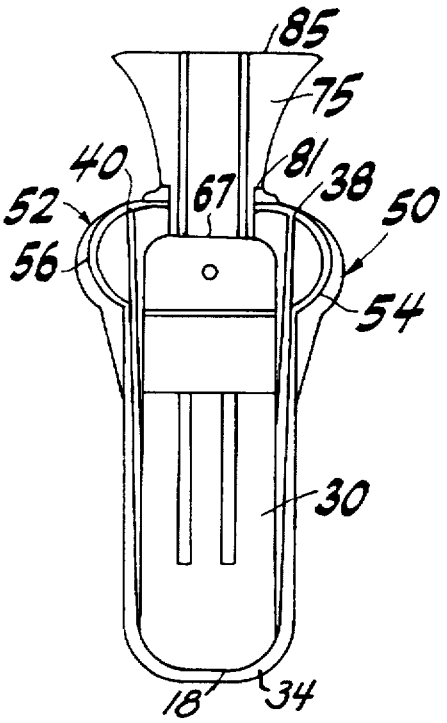
FIG. 4 illustrates an end view of the first embodiment.

FIG. 1 illustrates a first embodiment of the invention and shows a wringing device 10 that comprises a base element 12, which is U-shaped along its longitudinal axis. As shown in FIG. 4, the base element 12 has two side walls 14 and 16, which form an acute angle opening towards the top and comprise the sides of the U profile. The side walls 14 and 16 are connected by means of a bottom 18, which is preferably channel shaped and comprises the crosspiece of the U profile of the base element 12. The side walls 14 and 16 and bottom 18 may be formed as a unitary element.

As shown in FIG. 1, cylindrical wringing rollers 20 and 22 are mounted atop each of the two side walls 14 and 16, respectively; each wringing roller rotates freely and does not shift axially. The wringing rollers are mounted adjacent to one another and form a roller nip 24 (see FIG. 3), which is the area where the mop head carrier with the wet mop head on it is inserted. The axes of two wringing rollers 20 and 22 are coplanar and parallel to one another. This arrangement permits parallel rotation of the wringing rollers 20 and 22. In addition, when the side walls 14 and 16 are spread apart, the axes of the rollers 20 and 22 remain parallel.

The side walls 14 and 16 of the base element 12 are structured to be resilient, so that they counter a spreading force with elastic bending resistance. As illustrated in FIGS. 1 and 4, the side walls 14 and 16 and the bottom 18 are provided with reinforcement ribs 34 on their outer sides; the ribs 34 extend orthogonally to the lengthwise direction of the base element 12 and are spaced apart from one another. The width of the reinforcement ribs 34 increases towards the bottom 18 to provide an increasing resilient rigidity of the side walls 14 and 16 when they are spread apart by the insertion of the mop head. To ensure resiliency, the base element 12 comprises a material that produces an elastic prestress force. Possible materials include polypropylene, high-impact polyethylene, polyurethane or also stainless spring steel.

Figure 2:
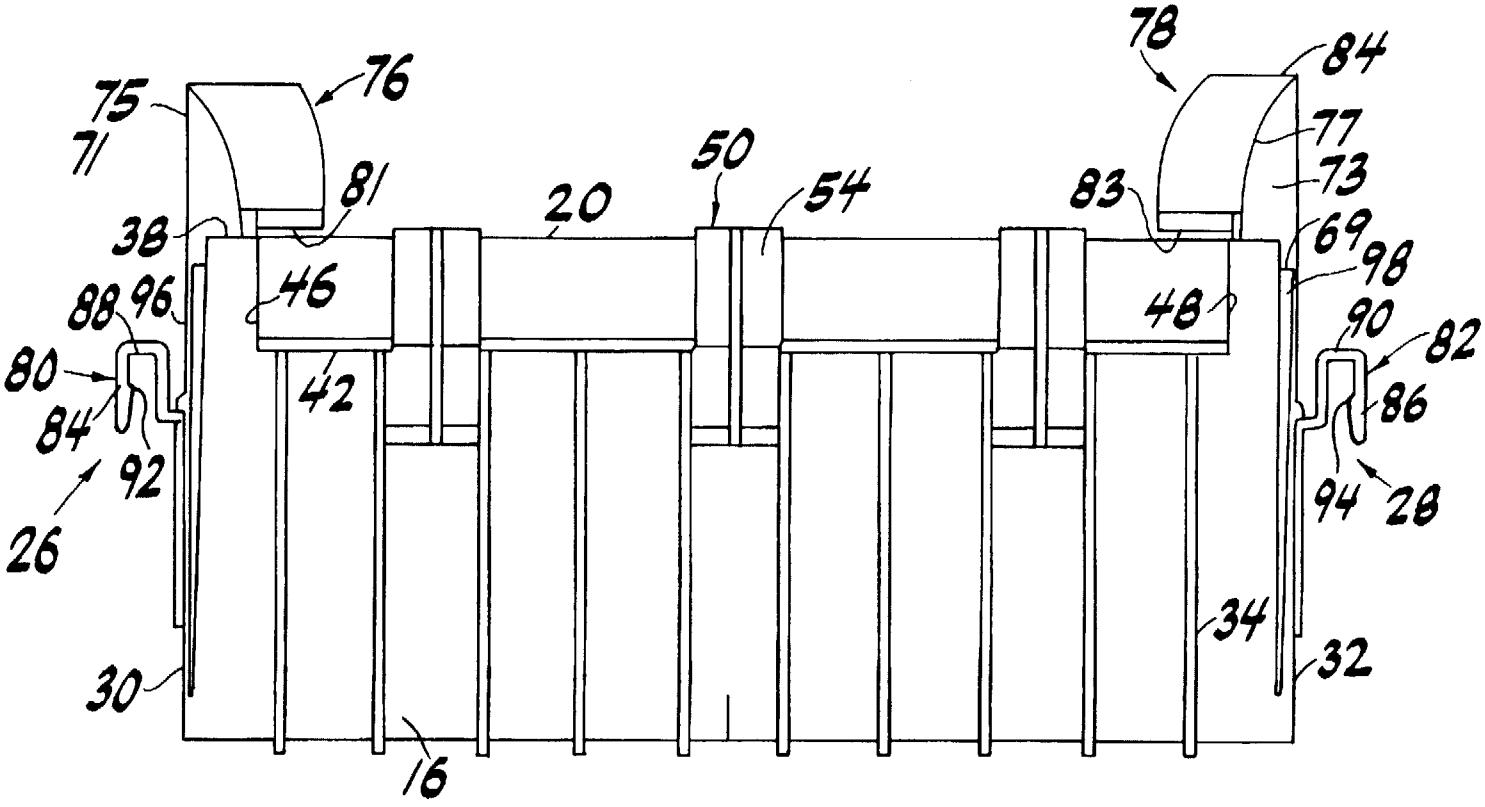
FIG. 2 illustrates a side view of the first embodiment.

As shown in FIGS. 1 and 2, the two ends of base element 12 are essentially covered by the end walls 30 and 32, which are resiliently connected with the bottom 18 of the base element 12 at their bottom end; the end walls 30 and 32 gradually extend away from the side edges of side walls 14 and 16, respectively. This expansion creates interstices 96 and 98 between the end walls 30 and 32 and the edge of side walls 14 and 16, respectively (see FIGS. 1 and 2). The interstices serve as drain openings for the cleaning solution pressed out of the wet mop head. In addition, drain openings are provided in the bottom 18 of the base element 12 in the center between the reinforcement ribs 34 (not shown).

Figure 3:
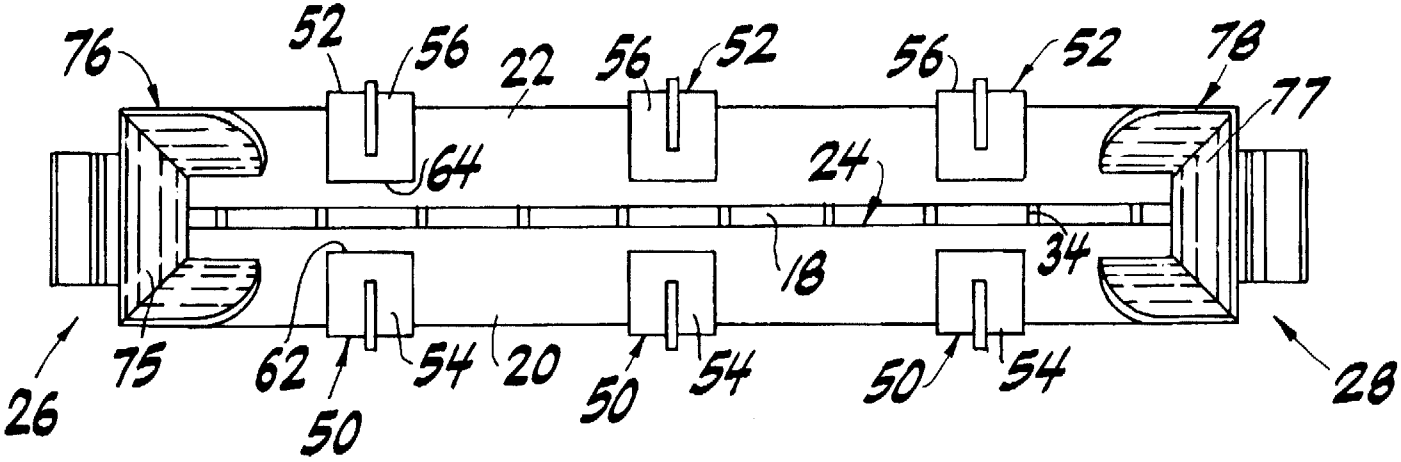
FIG. 3 illustrates a top view of the first embodiment.

As illustrated in FIGS. 2 and 3, two attachment devices 26 and 28 are molded onto end walls 30 and 32, respectively, of the base element 12. The attachment devices 26 and 28 comprise snap-hooks 80 and 82, respectively, which have an inverted U-shape with outer U-flanges 84 and 86, respectively, which project downward. The attachment devices 26 and 28 secure the wringing device 10 to a collection container having a rim (not shown) by clamping themselves to the rim or by using other catch-structure; FIG. 2 illustrates that catch shoulders 92 and 94 are formed on the interior surface of the outer U shanks 84 and 86, respectively, which engage the outer surface of the collection container, such as a bucket, just below the rim when the snap hooks 80 and 82 are pressed onto the container rim. The clamping mechanism may be released so that the wringing device 10 may be removed. A collection container provides a receptacle to collect the cleaning solution squeezed out by the wringing device 10.

As shown in FIG. 1, side walls 14 and 16 have upper edges 38 and 40, respectively, which are approximately parallel to each other. FIGS. 1 and 2 illustrate that a rectangular cut-out 42 is located in the side wall 14; another cut-out (not visible here) is located in an identical location in side wall 16. Cut-out 42 has two vertical narrow sides 46 and 48 that extend down from edge 38; the length of the sides 46 and 48 is slightly less than the diameter of wringing roller 20. The longitudinal length of cut-out 42 is slightly greater than the length of wringing roller 20, which prevents axial shifting of wringing roller 20. The same dimensional constraints apply to the cut-out in side wall 16.

As illustrated in FIG. 3, three bearings 50 are located in the region of the cut-out 42, and three bearings 52 are located in the region of the cut-out located on side wall 16. The bearings 50 secure wringing roller 20 in place, and bearings 52 secure wringing roller 22. As shown in FIG. 1, bearings 50 and 52 project upward beyond the lengthwise edges 38 and 40.

As shown in FIG. 1, each bearing 50 and 52 comprises an open bushing 54 and 56, respectively. The bushings 54 and 56 are partially tubular segments and molded onto the outside of the two side walls 14 and 16, respectively. Each bushing 54 and 56 is provided with a holder opening 58 and 60, respectively, for receiving the corresponding wringing roller 20 and 22, respectively. The holder openings 58 and 60 are dimensioned to be smaller than the diameters of wringing rollers 20 and 22, respectively. The top, free ends 62 and 64 of bushings 54 and 56, respectively, are structured to be resilient, so that the bushings 54 and 56 will bend upward from the side and then snap into place around the wringing roller 20 and 22 when they are inserted. The bushings 54 and 56 have an open cross-section that conforms to the diameter of the wringing rollers 20 and 22, to an extent permitting the wringing rollers 20 and 22 to rotate freely therein while still preventing unwanted axial displacement.

Each holder opening 58 and 60 is therefore delimited by at least one elastic device formed by the bushings 54 and 56 themselves. For this purpose, the bushings 54 and 56 are composed of a resilient material, preferably plastic. The radius of the arc that defines the cross-section of the bushings 54 and 56 approximately corresponds to the radius of the wringing rollers 20 and 22, respectively. The arc that defines the cross-section of each holder opening 58 and 60 subtends an angle of less than 180°, in order to achieve the desired snap-in effect of the rollers 20 and 22.

The distance from the roller nip 24 of the wringing rollers 20 and 22 to the surface of the bottom 18 is less than the height of each narrow side of the mop head carrier for the wet mop head, so that the mop head carrier can be lifted out of the wringing device 10 without expending a lot of force, after the cleaning solution has been wrung out of the mop head.

Figure 5:
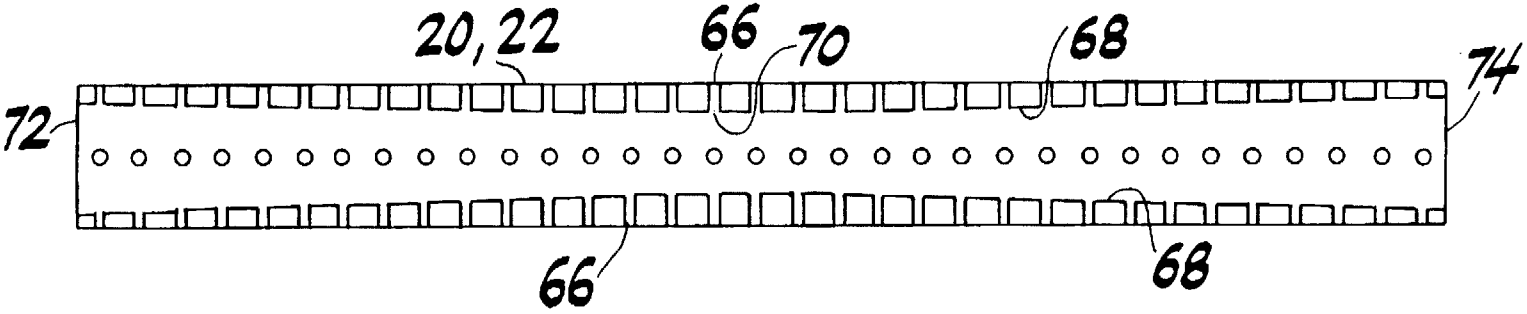
FIG. 5 illustrates a longitudinal cross-sectional view of a wringing roller.
Figure 6:
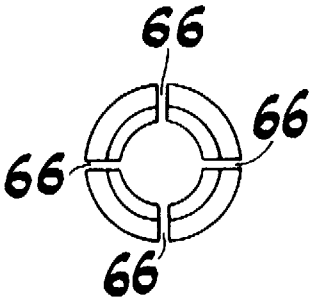
FIG. 6 illustrates a radial cross-sectional view of a wringing roller.

As shown in FIG. 6, the wringing rollers 20 and 22 are tube shaped and provided with a plurality of radially oriented drain openings 66. FIGS. 5 and 6 illustrate that the wringing rollers 20 and 22 comprise a series of equally spaced quartets of drain openings, wherein each quartet comprises 4 drain openings 66 that are spaced apart by 90° intervals. The drain openings 66 extend in the radial direction from the inside wall 68 to the outer surface of the wringing rollers 20 and 22. Other hole patterns, such as spiral-shaped patterns, can also be selected for the drain openings 66.

The thickness of the inside wall 68 of each wringing rollers decreases from center 70 towards its two ends 72 and 74. As shown in FIG. 5, the inside wall 68 has its greatest thickness in the lengthwise center 70 of each wringing roller 20 and 22; therefore, the interior of each wringing roller from its center 70 towards its ends 72 and 74 is frusto-conically shaped. This design significantly improves the drainage of cleaning solution that has been pressed out of the mop head and has penetrated the interior of wringing rollers 20 and 22 through the drain openings 66.

As shown in FIGS. 1–4, side guides 76 and 78 are located above the two wringing rollers 20 and 22 and serve to center the mop head carrier when it is inserted into the wringing device 10. As shown in FIG. 2, the side guides 76 and 78 have top insertion ends 85 and 87 and bottom ends 81 and 83, respectively. The bottom ends 81 and 83 are located directly above the two wringing rollers 20 and 22. As shown in FIG. 3, these side guides 76 and 78 are channel-shaped when viewed from the top, and the channels of the side guides 76 and 78 face each other. As shown in FIG. 4, the width of the cross-piece 75 curves inwardly from the top insertion end 85 to the bottom end 81. The same applies to cross-piece 77. The width of the cross-pieces 75 and 77 at the bottom ends 81 and 83, respectively, is adapted to the thickness and the length of the mop head carrier with the wet mop head on it. As shown in FIGS. 1 and 2, each cross-piece 75 and 77 is rigidly connected on its outer surface with two vertical, parallel, spaced apart pairs of support ribs 71 and 73, respectively. Each pair of support ribs 71 and 73 is attached to a horizontal support plate 67 and 69, respectively. The two support plates 67 and 69 are supported in suitable manner on the inner surfaces of the end walls 30 and 32, respectively. The support plates 67 and 69 extend from the inner surface of the end walls 30 and 32, respectively, towards the center of the wringing device 10. The support plates are positioned below the top edges 38 and 40 of the side walls 14 and 16. Therefore, if a mop head carrier is not centered properly and hits against a surface, particularly against one of the two cross-pieces 75 and 77, the side guide in question (76 or 78) can absorb the impact resiliently, with the related side wall, and the mop head carrier can then be centered between the two side guides above the roller nip 24.

To use the wringing device 10 with a mop head carrier with a wet mop head mentioned above (also referred to as a flat mop), the wringing device 10 is first removably connected with the top edge of a collection container, such as a bucket, using the snap hooks 80 and 82. The approximately rectangular mop head carrier is then inserted between the two side guides 76 and 78, above the pair of wringing rollers 20 and 22, with both of its narrow edges. Upon insertion, the side guides 76 and 78 vertically align the mop head carrier such that the mop head carrier can be pressed between the wringing rollers 20 and 22, which allows the mop head carrier to be pressed further down into the base element 12.

During this process, the wringing rollers 20 and 22 are pressed resiliently apart when the mop head carrier is inserted. Since the bushings 54 and 56 are connected to the wringing rollers 20 and 22 and with side walls 14 and 16, respectively, the side walls 14 and 16 are also bent outward. Because of the inherent stiffness of the base element 12, this expansion causes an elastic stress in the side walls 14 and 16 and in the bottom 18 of the base element 12 that attempts to return the base element to its undeformed position. This stress exerts a force that is transferred to the wringing rollers 20 and 22 and thus to the contact surface between the wringing rollers 20 and 22 and the wet mop head. In combination with the contact surface, the necessary squeezing pressure is therefore produced, which presses the cleaning solution out of the mop head.

The side guides 76 and 78 on both ends of the wringing device 10 for the mop head carrier ensure that cleaning solution is always collected above the opening of the collection container during the wringing process and drained into it. The centered arrangement of the wringing device 10 on the opening of the collection container also prevents the splashing of cleaning solution over the long side edges of the collection container. Furthermore, the walls of the collection container themselves act as splash guards because the wringing device 10 is arranged within the walls.

As previously mentioned, the height of the base element 12 between its bottom 18 and the roller nip 24 is dimensioned to be slightly less than the height of the vertically directed narrow sides of the approximately rectangular mop head carrier. Thus, when the mop head carrier is inserted between the wringing rollers 20 and 22, the upper edge of the mop head carrier still projects slightly beyond the top of the roller nip 24 when it contacts the bottom 18 of the base element 12.

The pressing force exerted by the side walls 14 and 16 squeezes the mop head again when the mop head carrier is pulled out of the wringing device 10. The pressing force exerted by the resilient side walls 14 and 16 combines with the friction between the two wringing rollers 20 and 22 and their respective bearings 50 and 52 to create an upwardly directed friction force. If the friction force exceeds the total weight of the collection container filled with cleaning solution and the wringing device 10 mounted on it when the mop head carrier is pulled out of the wringing device 10, the entire assembly may be lifted off the collection container. One measure that may be taken to prevent this from occurring is to arrange a spring-supported ejector above the bottom 18 of the base element 12, which facilitates extraction of the mop head carrier from the wringing device 10. This ejector device is a feature of the second embodiment and is discussed in more detail there. Another countermeasure that may be taken is to arrange a step surface that projects laterally from the bottom of the collection container, which allows the user to counter the friction force by putting his/her foot onto this step. Finally, one may alleviate this concern by reducing the friction force between the wringing rollers 20 and 22 and their respective bearings 50 and 52 by using materials that provide the lowest possible friction coefficient, such as poly-oxy methylene with polytetrofluoroethylene/high density polyethylene. These design measures may be provided on the wringing device 10 individually or in combination.

Increasing the roller pressing force increases the degree of wringing. One way to increase the roller pressing force is to make the base element 12 stiffer. Also, the wringing rollers 20 and 22 with radial drain openings 66 in their cylindrical walls can be used to increase the degree of wringing. The cleaning solution flows from inside the wringing rollers 20 and 22 and through the drain openings 66 and to the outer ends of each wringing roller 20 and 22 due to the design of the interior wall 68, whose thickness decreases from its center towards its ends such that the interior of each roller from its center to its ends is frusto-conically shaped. This design allows the cleaning solution that is pressed out to be transported away more rapidly and the squeezing pressure to be partially increased by means of the reduced surface area, so that the degree of wringing is improved.

Figure 9:
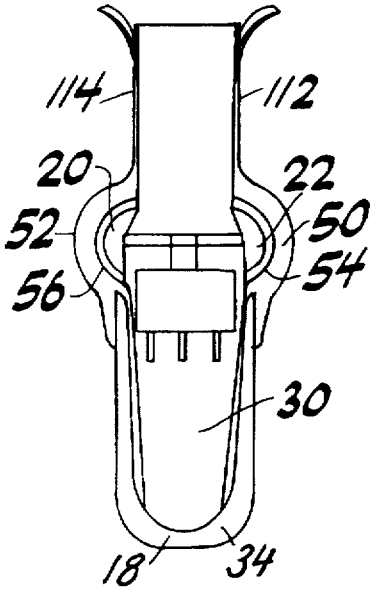
FIG. 9 illustrates an end view of the second embodiment.

A second embodiment of the wringing device is illustrated as 110 in FIGS. 7–10. Here, as shown in FIG. 9, guide elements 112 and 114 are connected directly with the bearings 50 and 52, respectively. The top ends of the guide elements extend above the side guides 76 and 78. This configuration prevents the mop head from tilting to the side when it is introduced into the wringing device 110. By directly connecting the guide elements 112 and 114 with the bearings 50 and 52, respectively, the distance between the mop head and the guide elements 112 and 114 is kept small. When the mop head is introduced between the wringing rollers, the guide elements 112 and 114 bend open when the wringing rollers 20 and 22 expand and therefore prevents jamming of the mop head between the guide elements 112 and 114.

Figure 7:
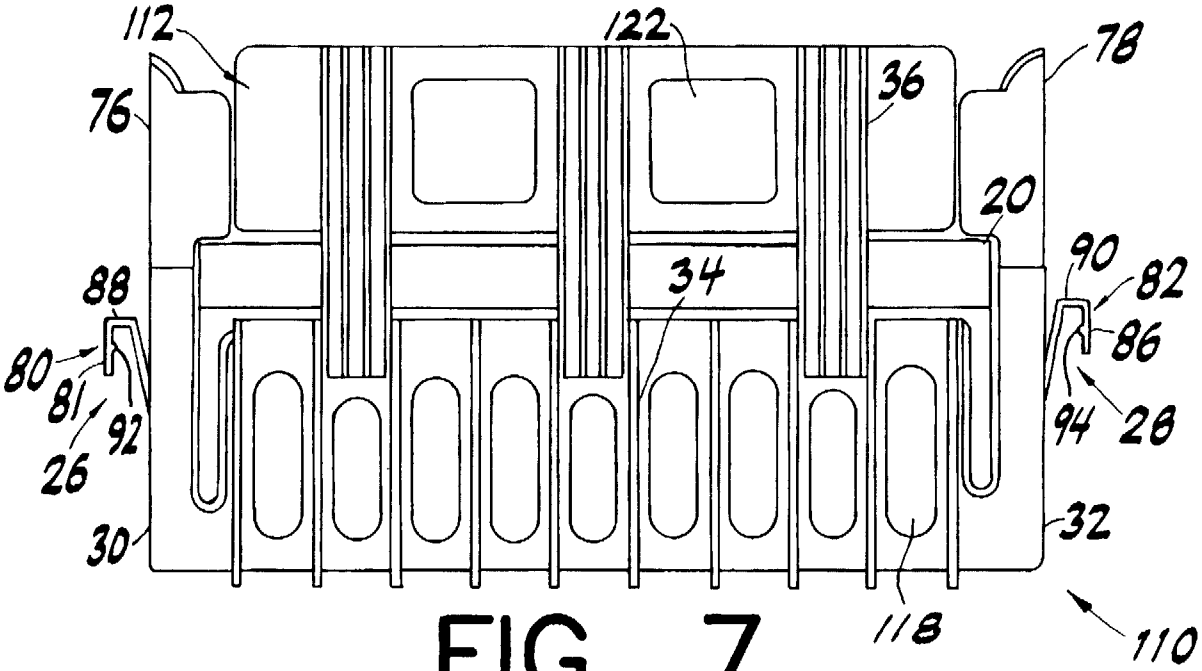
FIG. 7 illustrates a side view of a second embodiment of a wringing device.
Figure 8:
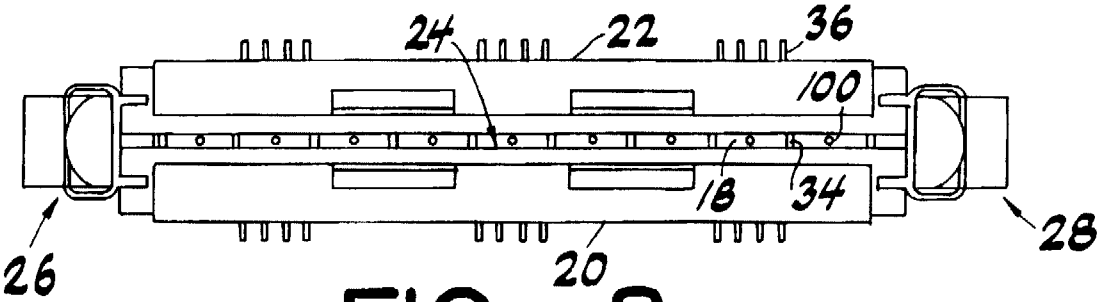
FIG. 8 illustrates a top view of the second embodiment.

As illustrated in FIGS. 7 and 8, reinforcement ribs 34 are provided on the side walls 14 and 16, while reinforcement ribs 36 are provided on guide elements 112 and 114. In addition, the side walls 14 and 16 are provided with pockets 120 of reduced material thickness between the reinforcement ribs 34; pockets 122 of reduced material thickness are also provided on the guide elements 112 and 114 between the reinforcement ribs 36. Since reinforcements ribs 34 and 36 provide structural stiffness, the pockets 120 and 122 serve to reduce the amount of material used.

Figure 10:
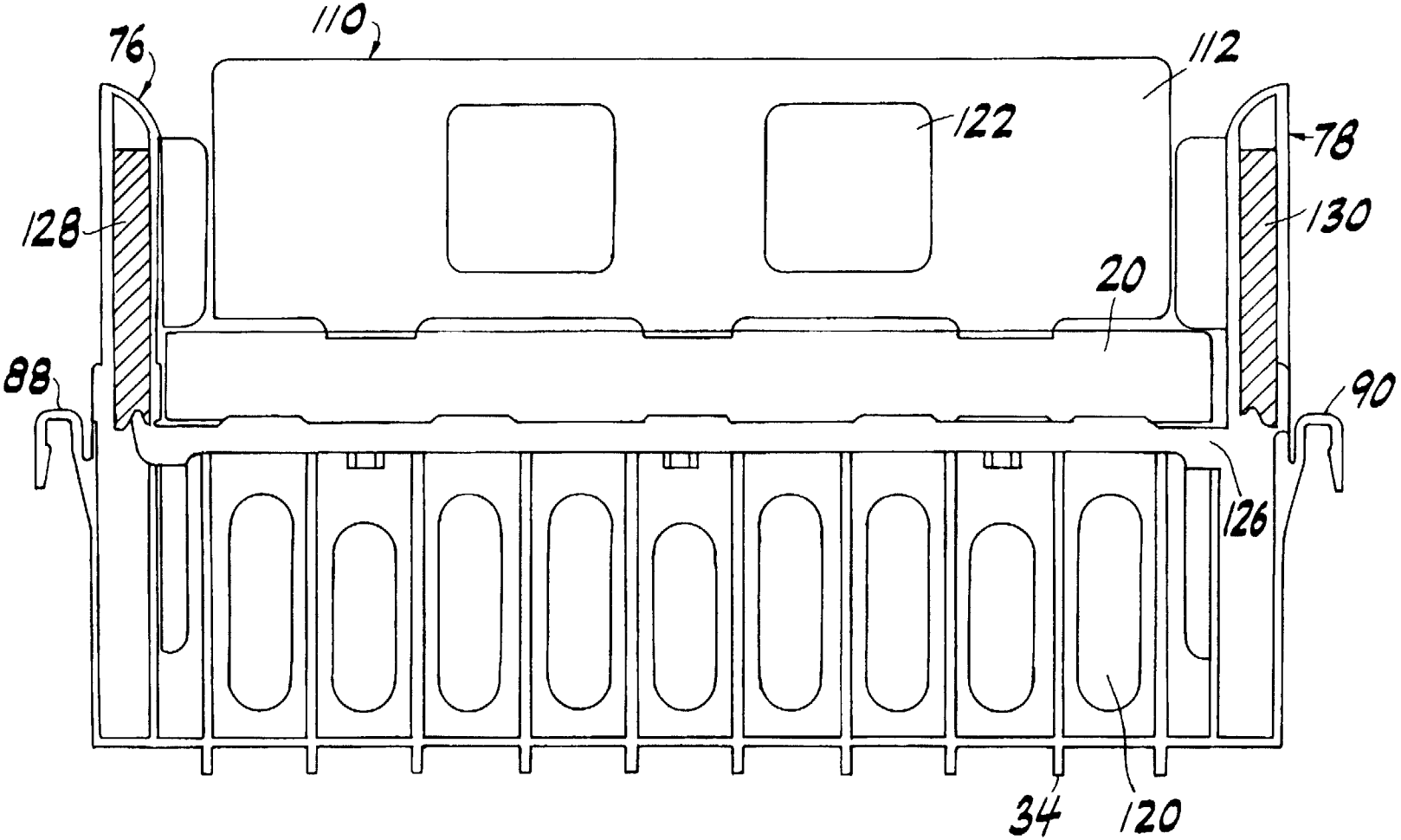
FIG. 10 illustrates a longitudinal cross-sectional view of the second embodiment.

FIG. 10 is an illustration of a further feature of the second exemplary embodiment. The side guides 76 and 78 have ejector springs 128 and 130, respectively. These ejector springs and an elongated ejector device 126 to which the springs are connected as shown in FIG. 10 (in which the ejector springs 128 and 130 are shown in their relaxed state) facilitate the process of pulling the mop head out of the wringing device if the pressing force is very high. Without such an ejector device, the mop head may jam between the rollers. The ejector springs 128 and 130 are prestressed when the mop head is inserted into the wringing device, and maintain their tension until ejection.

The guide elements 112 and 114, pockets 120 and 122 of reduced material thickness, and the ejector device 126 may be added to the first embodiment of the wringing device 10 individually without impairing the effectiveness of the invention. In particular, the additional elements of the guide elements 112 and 114 with roller holder and pockets 120 and 122 are functionally independent of one another. In the preferred embodiment of the invention, the extended guide elements 112 and 114, the pockets 120 and 122, and the ejector device 126 with the ejector springs 128 and 130 are all provided. The guide elements 112 and 114 and the bearings 50 and 52 may be constructed as a unitary element.

What is claimed is:

1. A device for wringing liquid out of a wet mop head, the wringing device comprising:

a base element having two ends and an outside surface and comprising a resilient material that is elastically prestressed, and wherein the base element has a U-shaped cross-section formed of two side walls having top, lengthwise edges and end edges, and a channel-shaped bottom that joins the side walls;

two cylindrical wringing rollers that are mounted in the base element and positioned adjacent to each other such that a roller nip is formed between the wringing rollers the axes of rotation being parallel to each other and the wringing rollers being designed to move away from one another counter to the elastic prestress force in the base element while the axes of rotation remain parallel.

2. The wringing device according to claim 1, wherein the top lengthwise edges of the side walls of the base element are parallel to one another and are equipped with bearings for the wringing rollers.

3. The wringing device according to claim 2, wherein the bearings comprise at least two bushings that have free, top ends.

4. The wringing device according to claim 3, wherein the bushings have an open cross section that conforms to the cross-section of the wringing rollers.

5. The wringing device according to claim 4, wherein each bushing further comprises a holder opening, which permits insertion of a wringing roller, each holder opening subtending an arc over the circumference of the related bushing of less than 180°.

6. The wringing device according to claim 5, wherein each holder opening is delimited by at least one elastic device.

7. The wringing device according to claim 6, wherein the elastic device of each holder opening is formed by a free, top end of the bushings.

8. The wringing device according to claim 7, wherein the same number of holder openings are affixed to each of the side walls and are positioned to face the holder openings affixed to the other side wall.

9. The wringing device according to claim 3, wherein the bushings extend upward beyond the top lengthwise edges of the two side walls of the base element.

10. The wringing device according to claim 9, wherein the two ends of the base element are covered by end walls, and wherein the side walls, end walls and the bushings are formed as a unitary element.

11. The wringing device according to claim 10, wherein the unitary element comprises a one-piece injection-molded plastic part.

12. The wringing device according to claim 10, wherein the unitary element comprises stainless spring steel.

13. The wringing device according to claim 1, wherein the distance of the roller nip of the wringing rollers to the bottom of the base element is dimensioned to be less than the height of each narrow side of a mop head carrier.

14. The wringing device according to claim 1, wherein the bottom of the base element is provided with drain holes.

15. The wringing device according to claim 1, wherein the wringing rollers are tube shaped and have two ends, a lengthwise center, an interior and an inside wall.

16. The wringing device according to claim 15, wherein the tube shaped wringing rollers are provided with radially oriented drain openings.

17. The wringing device according to claim 15, wherein the thickness of the inside wall of each wringing roller decreases from its lengthwise center towards its two ends such that the interior of the wringing roller is frusto-conically shaped from its lengthwise center to each end.

18. The wringing device according to claim 1, wherein the outside surface of the base element is provided with reinforcement ribs.

19. The wringing device according to claim 18, wherein the reinforcement ribs are equally spaced along the base element and extend from the top, lengthwise edge of one side wall to the top, lengthwise edge of the other side wall, the ribs increasing in width towards the bottom of the base element.

20. The wringing device according to claim 18, wherein pockets of reduced material thickness are provided on the side walls of the base element between the reinforcement ribs.

21. A device for wringing liquid out of a wet mop head, the wringing device comprising:

a base element having two ends and an outside surface and comprising a resilient material that is elastically prestressed, the two ends of the base element being covered by end walls having top ends;

two cylindrical wringing rollers that are mounted in the base element and positioned adjacent to each other such that a roller nip is formed between the wringing rollers, the axes of rotation being parallel to each other and the wringing rollers being designed to move away from one another counter to the elastic prestress force in the base element while the axes of rotation remain parallel.

22. The wringing device according to claim 21, wherein the end walls are formed at the top ends thereof with side guides for a mop head carrier, said side guides each having top and bottom ends and extending vertically.

23. The wringing device according to claim 22, wherein the side guides have a U-shaped cross-section when seen from the top end that comprises a cross-piece, the side guides being positioned such that the interior surfaces of the cross-pieces face each other.

24. The wringing device according to claim 23, wherein the side guides are arranged symmetrically above the roller nip of the two wringing rollers.

25. The wringing device according to claim 24, wherein the width of the cross-piece of each side guide decreases from its top end to its bottom end, the bottom end being located at a distance above the two wringing rollers and having a width that is adapted to the width and the length of a mop head carrier.

26. The wringing device according to claim 22, wherein the wringing device further comprises an ejector device that is affixed in the vicinity of the wringing rollers and ejector springs having first and second ends that are affixed at a first end to the side guides and at a second end to the ejector device.

27. The wringing device according to claim 21, wherein the base element has a bottom, side walls, and end edges, and wherein the two end walls of the base element are resiliently connected with the bottom of the base element and extend away from the end edges of the side walls of the base element.

28. The wringing device according to claim 21, wherein attachment devices are located at the top end of the end walls.

29. The wringing device according to claim 28, wherein the attachment devices are formed as snap hooks.

30. The wringing device according to claim 21, wherein the wringing device further comprises guide elements that project above the end walls.

31. The wringing device according to claim 30, wherein the wringing device further comprises reinforcement ribs located on the guide elements.

32. The wringing device according to claim 31, wherein pockets of reduced material thickness are provided on the guide elements between the reinforcement ribs.

33. The wringing device according to claim 30, wherein the base element comprises side walls and wherein the wringing device further comprises reinforcement ribs on the guide elements and on the side walls of the base element.

34. The wringing device according to claim 33, wherein pockets of reduced material thickness are provided on the guide elements and side walls of the base element.

35. The wringing device according to claim 30, wherein the guide elements are connected with bearings.

* * * * *